US006435271B1

(12) United States Patent
Pavlin

(10) Patent No.: US 6,435,271 B1
(45) Date of Patent: Aug. 20, 2002

(54) HEAT EXCHANGER WITH AT LEAST ONE CONNECTING ELEMENT

(75) Inventor: Jaroslav Pavlin, Freiberg (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/763,171

(22) PCT Filed: May 8, 1999

(86) PCT No.: PCT/EP99/03167

§ 371 (c)(1),
(2), (4) Date: Apr. 12, 2001

(87) PCT Pub. No.: WO00/11425

PCT Pub. Date: Mar. 2, 2000

(30) Foreign Application Priority Data

Aug. 20, 1998 (DE) ..... 198 37 807

(51) Int. Cl.[7] ..... F28F 9/04; F28F 3/08
(52) U.S. Cl. ..... 165/178; 165/167
(58) Field of Search ..... 165/178, 167, 165/916; 285/189, 382.7

(56) References Cited

U.S. PATENT DOCUMENTS 4,831,980 A * 5/1989 Nasu et al. ..... 123/196 A
5,014,775 A * 5/1991 Watanabe ..... 165/916
5,165,468 A * 11/1992 Tajima et al. ..... 165/916
5,555,929 A * 9/1996 Ishikawa ..... 165/178
5,894,886 A * 4/1999 Chiba et al. ..... 165/174

FOREIGN PATENT DOCUMENTS

EP 505244 A1 * 9/1992 ..... 165/178

* cited by examiner

*Primary Examiner*—Henry Bennett
*Assistant Examiner*—Tho V Duong
(74) *Attorney, Agent, or Firm*—Crowell & Moring LLP

(57) ABSTRACT

A heat exchanger (10) connectable with at least one connecting element (11). The heat exchanger is made up of a stacked structure and has holding devices (17) embodied as part of a heat exchanger housing. The holding devices can be produced by deforming an end plate (18) of the heat exchanger or they may be soldered on the end plate (18) in the form of profiled strips (24). The connecting element has corresponding locating elements (19), and assembly is carried out by deforming the holding devices (17) or by configuring the holding devices in the form of a bayonet lock. The integration of the holding devices (17) into the end plate (18) of the heat exchanger has the advantage of reducing manufacturing costs and simplifying assembly.

2 Claims, 2 Drawing Sheets

HEAT EXCHANGER WITH AT LEAST ONE CONNECTING ELEMENT

BACKGROUND OF THE INVENTION

The invention relates to a heat exchanger with at least one connecting element. In addition, the invention relates to a process for the production of a connection between a heat exchanger and a connecting element.

A heat exchanger with stacked construction is known, for example, from DE 93 09 741. This heat exchanger comprises trough-shaped stacked blanks placed within one another, and also closing or end plates. The components are soldered to one another and in this way provide a system sealed to the external environment. Inlets and outlets are provided for the coolant circuit and for the circuit for the fluid to be cooled.

At least one of the end plates is constructed as a flange for attachment of the heat exchanger. This flange can be provided with bores and attached to the intended mounting location with the aid of, e.g., screws. However, this solution has the disadvantage of the additionally resulting work cycle for providing the bores in the end plates. A bore must also be provided on the mounting location, possibly with threads. The screws used as fasteners also require an additional expenditure for components.

The production of the heat exchanger typically occurs in an oven. The components of the heat exchanger coated with a soldering material are loosely preassembled and provisionally fixed. The oven is at a temperature at which the soldering material melts and flows into the joints of the individual components. In this way, the components are attached to one another, and the circuits are sealed in relation to one another and to the environment.

SUMMARY OF THE INVENTION

The object of the invention is to provide a combination of the heat exchanger and/or its connecting elements which is optimized in regard to manufacturing expense, mounting expense, and/or functional reliability.

This object is achieved by the invention as described and claimed hereinafter. Furthermore, processes for the production of the connection between the heat exchanger and its connecting elements and/or the mounting location also fulfill the objects of the invention.

Advantages of the Invention

The combination of heat exchanger and connecting element according to the invention has an attachment mechanism which comprises holding devices on the heat exchanger which work together with locating elements on the connecting elements. Additional attachment means, such as, for example, screws, are not necessary. The holding devices are constructed as part of the housing.

The holding device and the locating elements have a simple geometry. The locating elements can therefore be provided in the original mold of the connecting elements. Additional work cycles, for example for the provision of bores which cannot be provided in the original mold without undercuts, are therefore unnecessary.

One practical embodiment of the inventive concept envisions production of the holding device by deformation of specific parts of the heat exchanger, particularly the end plates. The end plates are generally stampings and are frequently provided with beads for stiffening. In these process steps, holding devices can also be formed in the end plate without additional manufacturing expense. Therefore, almost no additional costs arise due to the provision of these types of holding devices.

Another variant of the holding device comprises profiled strips which are permanently soldered to the housing. The profiled strips can be produced from economically obtainable, semimanufactured products. They can be integrated into the loosely premounted bundle of stacked blanks of the heat exchanger at insignificant additional expense. A permanent attachment results between the profiled strips and housing due to the treatment in the oven. The treatment of the heat exchanger in the oven is a production step which results due to the stacked blank assembly of the heat exchanger. Therefore, no additional process step for attachment of the holding device to the heat exchanger is necessary in this variant either.

It is advantageous to provide locking devices in the connection between the holding device on the housing and the locating elements on the connecting elements. These have the purpose of preventing undesired soldering of the connection. If the connecting elements are made of synthetic resin material, the intrinsic elasticity of this material can be used, for example through the provision of resilient snap hooks. Providing locking devices has the advantage that the connection between the connecting elements and the heat exchanger can be made detachable.

Of course, the holding device on the heat exchanger and the locating elements on the connecting elements must correspond with one another. For this purpose it is particularly necessary that the connecting element be provided with an appropriate geometric configuration. This can be achieved in accordance with the invention, for example, by providing grooves or flanges on the connecting element which engage the holding devices on the heat exchanger. If the connecting elements are, for example, oil filters with an essentially centrally symmetric geometry, these grooves and/or flanges can be produced without undercuts by a parting line which runs through the axis of symmetry.

A process according to claim 7 may be used for mounting the connecting elements on the heat exchanger. In this process, the connecting element is brought to the assembly point provided on the heat exchanger. Subsequently, the holding devices are plastically deformed, for example through bending. A positive interlock is hereby produced between the connecting element and the heat exchanger. The connecting element hereby remains largely undeformed.

The connection described between the heat exchanger and the connecting element is not detachable unless one brings the holding device back into its original shape. Nonetheless, the mounting process through deformation of the holding element is very economical, particularly for large piece counts. The mounting can be performed by machine in an apparatus provided for this purpose.

As an alternative to this, a mounting process is claimed in which the connection between the heat exchanger and the connecting elements is produced by a relative motion of these parts. This can, for example, be realized by a kind of bayonet lock. The connecting element is placed onto the heat exchanger and affixed to the heat exchanger with a rotation.

These and further characteristics of preferred embodiments of the invention can be seen both from the claims and from the description and the drawings, and the individual features of the invention can be realized alone or jointly in the form of sub-combinations in embodiments of the invention and in other fields, and represent advantageous embodiments protectable in and of themselves, for which protection is claimed here.

BRIEF DESCRIPTION OF THE DRAWINGS

Further characteristics of the invention are described in the drawings with reference to illustrative schematic embodiments.

DETAILED DESCRIPTION OF PREFERRED EMBODIMENTS

Figure 1:
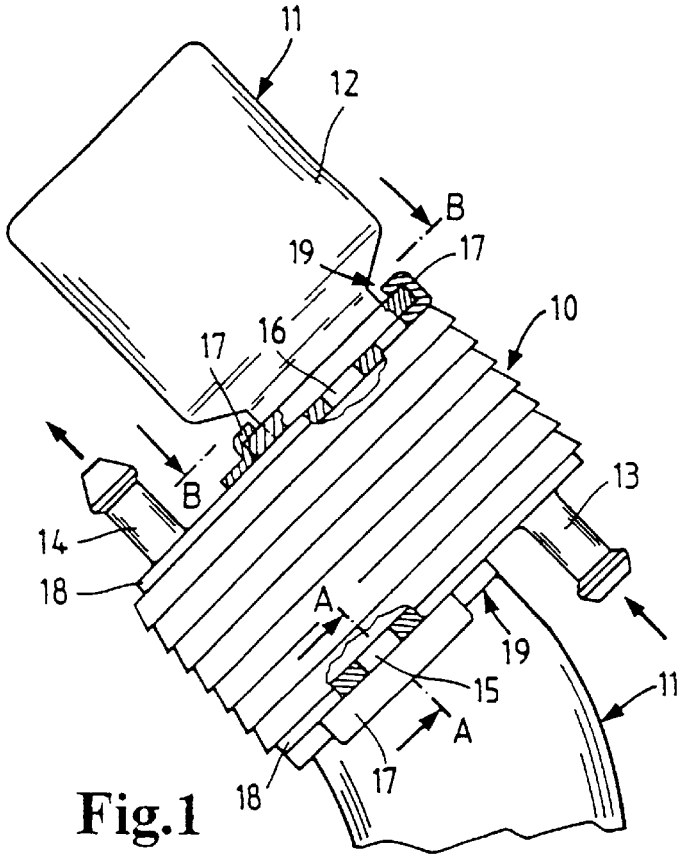
FIG. 1 shows an arrangement of the heat exchanger between two connecting elements in a side view.

A heat exchanger 10 with connecting elements 11 is depicted in FIG. 1. The connecting elements could, for example, be an oil filter 12 or the mounting location in the motor compartment, for example the engine block or the oil pump. The heat exchanger has a coolant inlet 13 and a coolant outlet 14, which in this case are constructed as hose supports for coolant hoses which are not shown. The connecting elements are connected to the heat exchanger via an inlet 15 and an outlet 16 for the fluid to be cooled.

The connections between the connecting elements 11 and heat exchanger 10 are ensured through cooperation between holding devices 17 on the end plate 18 of the heat exchanger 10 and locating elements 19 on the connecting elements 11. Different variants of this connection will be described in more detail in the following figures.

Figure 2:
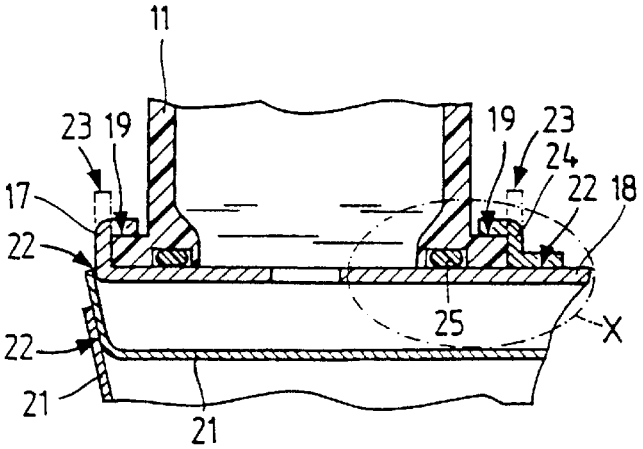
FIG. 2 shows the section A—A through the end plate of the heat exchanger according to FIG. 1 with holding device and the connecting element.

In FIG. 2, a mounted connecting element 11 on a heat exchanger is depicted in section. The heat exchanger is formed by trough-shaped stacked blanks 21, placed within one another, which are soldered to one another on their contact surfaces 22. Furthermore, a contact surface results between the uppermost stacked blank and the end plate 18, which forms the end of the heat exchanger and also has a soldered contact surface 22 to the uppermost stacked blank. An edge 23 on the margin of the end plate is bent outwardly and thereby forms one of the holding devices 17. A second holding device is formed by a profiled strip 24, which also has a contact surface 22 with the end plate 18, via which they are soldered together.

The edges 23 of the holding devices 17, with one of the holding devices constructed as a profiled strip 24, are shown as broken lines in FIG. 2. The edges assume these positions before mounting of the connecting element 11. The connecting element is inserted between the holding devices, and the edges of the holding devices are bent over. The holding devices 17 are depicted in FIG. 2 in the mounted condition of the connecting element 11. A gasket 25 is used as a seal between the connecting element 11 and the end plate 18. The holding devices are connected with the locating elements 19 of the connecting element 11.

Figure 3:
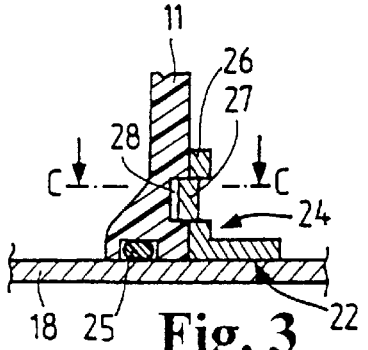
FIG. 3 shows a sectional view of an alternative construction of the holding device according to the detail X from FIG. 2.

An alternative geometric construction of the holding device is shown in FIG. 3. This comprises, similar to the one depicted in FIG. 2, of a profiled strip 24, which is soldered to the end plate 18 via the contact surface 22. The leg 26 of the holding profile 24, which stands at an angle of 90° to the surface of the end plate 18, is partially cut out. After insertion of the connecting element 11, the cut out parts 27 can be pressed through plastic deformation into grooves 28 provided for this purpose in the connecting element . The groove hereby assumes the function of the locating element in the connecting element 11.

Figure 4:
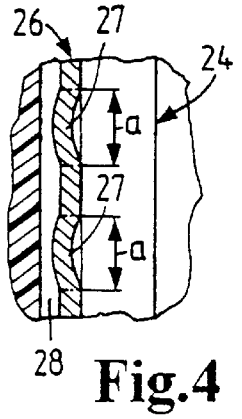
FIG. 4 shows the section C—C according to FIG. 3.

The engagement of the plastically deformed cut out parts 27 in the groove 28 can be seen in FIG. 4. The leg 26 of the profiled strip 24 is only cut out in the depicted regions A. The profiled strip 24 remains undeformed between these regions. The undeformed regions of the profiled strip 24 are additionally necessary so that it does not fall apart into several sections.

Figure 5:
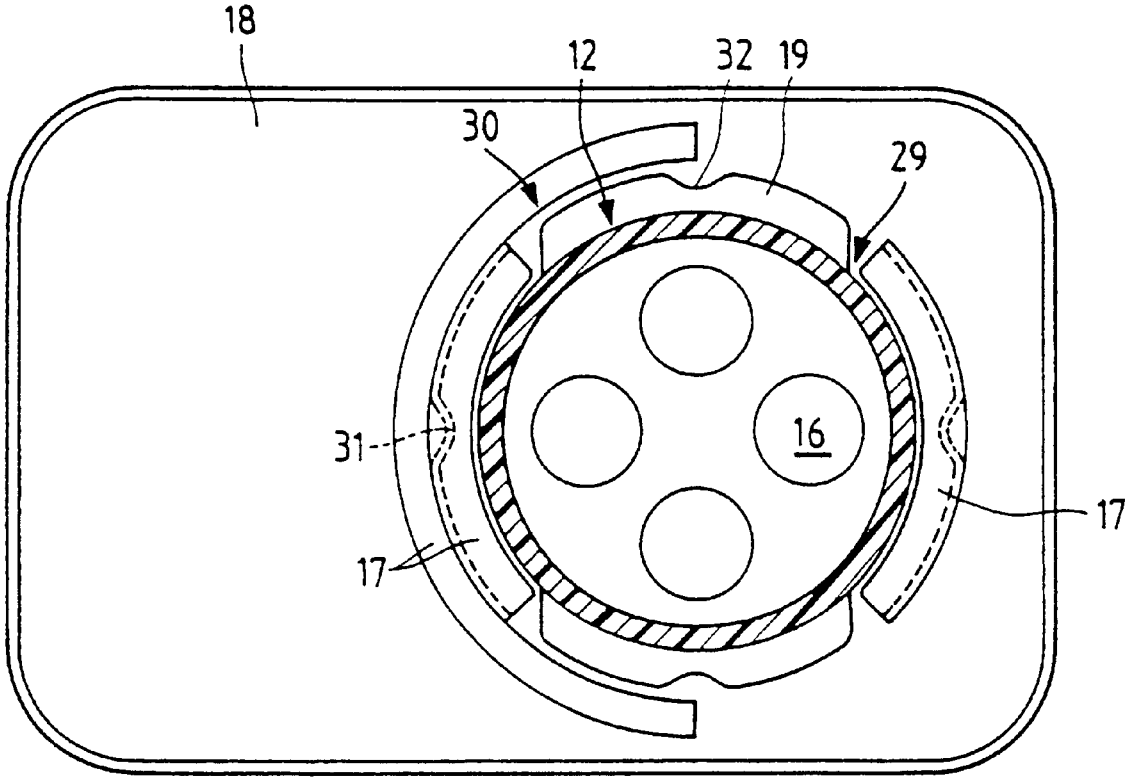
FIG. 5 shows the section B—B according to FIG. 1, which illustrates the manner of operation of one possible embodiment of the locking device.

In FIG. 5, a version of the holding devices 19 is depicted which is constructed as a bayonet lock. The holding devices are formed from the end plate 18 and the profiled strip 24, similar to those in FIG. 2. The filter 12 has a flange-like projection which assumes the function of the locating elements 19. In order that the oil filter may be placed between the holding devices, the flange-like projection has cut out areas 29. The oil filter can be inserted in a guide 30 provided for this purpose. Through subsequent rotation of the oil filter 12 through 90°, the locating elements 19 engage with the holding devices 17. A locking device 31, which is formed by corresponding indentations 32 in the holding device and/or in the oil filter, hereby engages.

Figure 6:
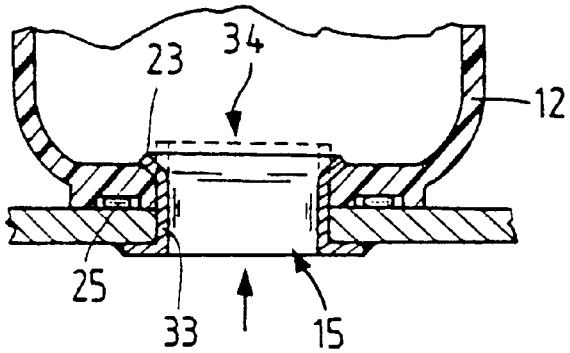
FIG. 6 shows an alternative construction of the holding devices, depicted according to the section A—A from FIG. 1.

FIG. 6 shows an alternative construction of the holding device. This comprises a bushing 33 which is, for example, soldered into the inlet 15. The oil filter 12 is pushed with its internal opening 34 onto the bushing, whereupon the bushing fixes the oil filter in place through plastic deformation. The edges 23 before the deformation of the bushing 33 due to mounting are shown as broken lines in FIG. 6.

What is claimed is:

1. A heat exchanger comprised of stacked and soldered blanks and at least one end plate, said heat exchanger having at least one inlet and at least one outlet for a fluid to be cooled, at least one coolant inlet and at least one coolant outlet, wherein at least one connecting element is connectable to the inlet or outlet for fluid to be cooled by connection means comprising a plurality of holding devices constructed as part of the end plate, and a plurality of locating elements on said connecting element which form a positive interlock with the holding devices essentially without deformation of the locating elements, wherein at least part of the holding devices is formed by a profiled strip permanently attached to the heat exchanger.

2. A heat exchanger according to claim 1, wherein said profiled strip is soldered to the heat exchanger.

* * * * *